United States Patent [19]

Saggers

[11] Patent Number: 4,722,332

[45] Date of Patent: Feb. 2, 1988

[54] INFLATABLE GARMENT FOR INTERMITTENT COMPRESSION THERAPY

[76] Inventor: Michael J. Saggers, 9 Pennycroft, Harpenden, Hertfordshire, AL5 2PD, Great Britain

[21] Appl. No.: 784,687

[22] PCT Filed: Jan. 30, 1985

[86] PCT No.: PCT/GB85/00046

§ 371 Date: Sep. 30, 1985

§ 102(e) Date: Sep. 30, 1985

[87] PCT Pub. No.: WO85/03219

PCT Pub. Date: Aug. 1, 1985

[30] Foreign Application Priority Data

Jan. 30, 1985 [GB] United Kingdom ..... 8402351

[51] Int. Cl.[4] ..... H61F 13/00

[52] U.S. Cl. ..... 128/165

[58] Field of Search ..... 128/165, 80

[56] References Cited

U.S. PATENT DOCUMENTS

| | | | |
|---|---|---|---|
| 2,943,859 | 7/1960 | Kuski et al. | 128/165 X |
| 3,153,413 | 10/1964 | Gottfried | 128/165 |
| 3,186,404 | 6/1965 | Gardner | 128/165 X |
| 3,245,405 | 4/1966 | Gardner | 128/165 X |
| 4,502,301 | 3/1985 | Swallow | 128/165 |

*Primary Examiner*—Gregory E. McNeill

*Attorney, Agent, or Firm*—Banner, Birch, McKie & Beckett

[57] ABSTRACT

An inflatable garment (12, 12', 46) for use in intermittent compression therapy includes a foot portion (36, 36', 74) formed by a plurality of inflatable sacs(s). The sacs are arranged such that when inflated pressure is applied thereby inwardly of the foot portion predominantly from above and from below a notional substantially horizontal plane (h) passing centrally through the foot portion of the garment.

5 Claims, 7 Drawing Figures

INFLATABLE GARMENT FOR INTERMITTENT COMPRESSION THERAPY

TECHNICAL FIELD

This invention relates to an inflatable garment for use in intermittent compression therapy and more particularly to a garment having a portion which substantially encases a patient's foot to be treated. Such a garment may also further include a leg portion which encases substantially the whole leg i.e. both calf and thigh; the lower leg i.e calf; or which further includes only an ankle portion. However, the present invention is concerned with improvements to the foot portion of such a garment and reference herein to leg garment is to be understood as including any of the garment forms referred to above.

BACKGROUND ART

Known inflatable leg garments are formed from a double skinned fabric blank which comprises integral mirror image leg-shaped parts. The blank is folded in half so that the leg shaped parts are brought into superposed relationship. Thereafter, a zip fastener is inserted in order to provide an openable front seam and the foot portions of the leg-shaped parts are welded and stitched together thereby forming a generally leg-shaped inflatable enclosure having a zip seam 's' and a welded seam 'w' as shown in FIG. 7.

In use, the garment is fitted about a patient's limb to be treated and cyclically is inflated and deflated to apply intermittent compression to the patient's limb. Whilst the known garment construction is generally satisfactory, the pressure applied by the foot portion during inflation of the garment can cause considerable pain to the patient because of the constricting shape which the foot portion of the garment is caused to adopt during inflation.

DISCLOSURE OF THE INVENTION

The present invention seeks to improve the configuration of the garment foot portion so as to provide an equivalent or improved intermittent compression therapy as compared with that given by known garment constructions whilst giving better comfort to the user and alleviating the pain.

To this end, the invention provides an inflatable garment for use in intermittent compression thereapy, which garment includes a foot portion provided by a plurality of inflatable sacs characterised in that the inflatable sacs are arranged such that, when inflated, pressure is applied thereby inwardly of the foot portion predominantly from above and from below a notional substantially horizontal plane passing centrally through the foot portion of the garment.

BRIEF DESCRIPTION OF THE DRAWINGS

Embodiments of the invention will now be described, by way of example, with reference to the accompanying drawings, in which.

BEST MODE FOR CARRYING OUT THE INVENTION

Figure 1:
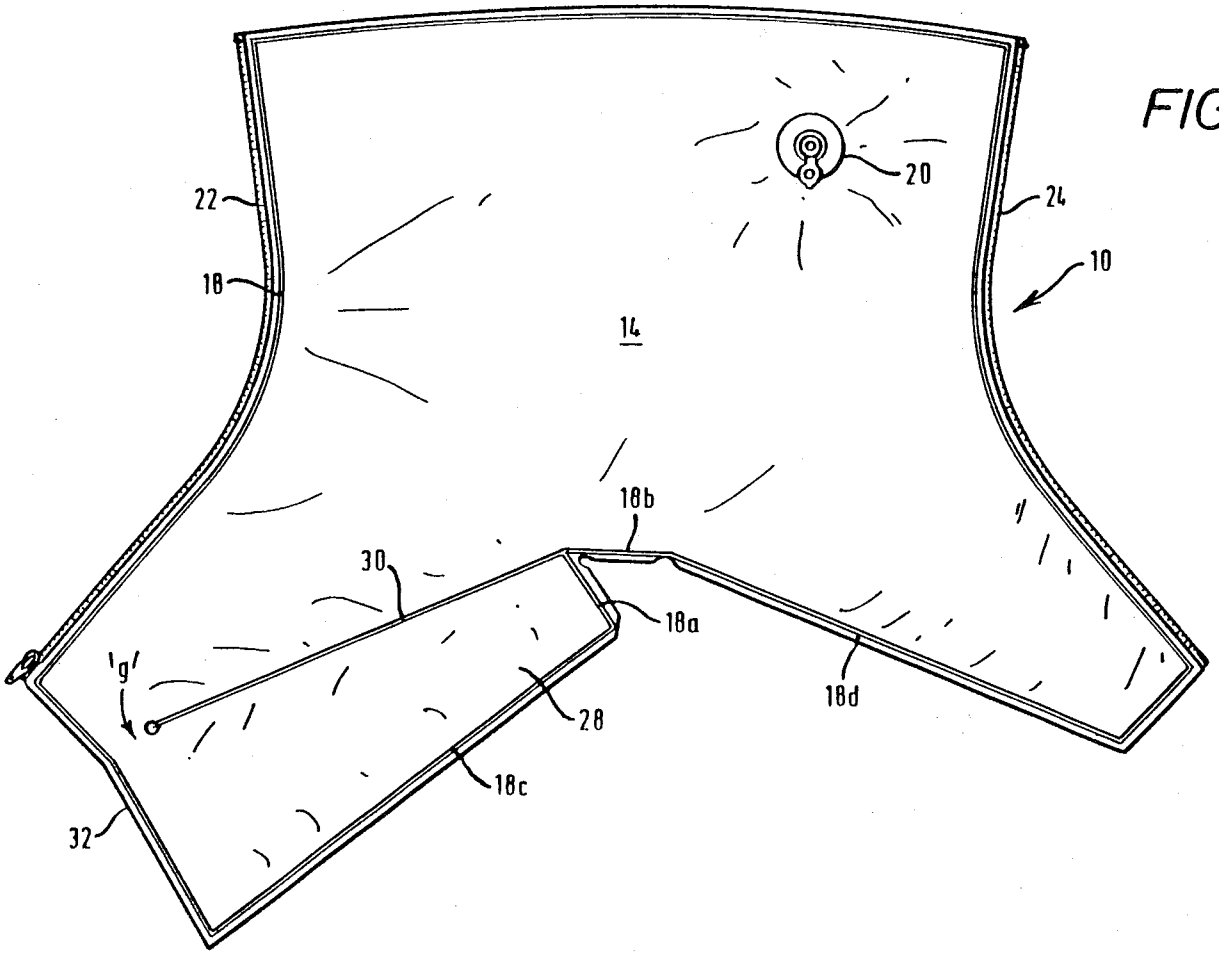
FIG. 1 is a plan view of a preferred fabric blank comprising two superposed sheets of material secured together to form an inflatable garment.
Figure 2:
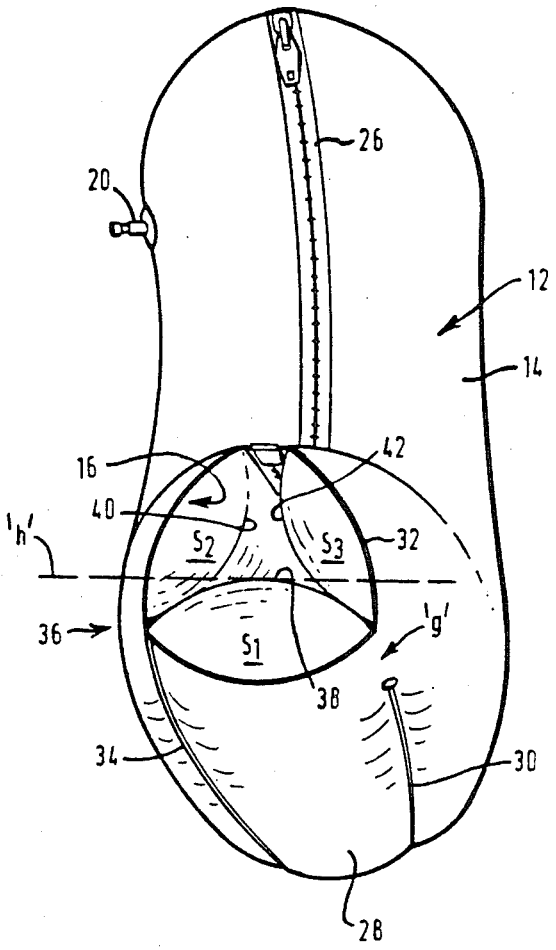
FIG. 2 is a perspective view of a garment in inflated condition as seen from the underside of the foot portion and formed from the fabric blank shown in FIG. 1.

Referring first to FIGS. 1 and 2, there is shown a leg garment blank 10 for forming an inflatable garment 12. The blank is formed from two superposed sheets 14,16 of material which will form outer and inner 'skins' of the garments, each comprising a woven Nylon (registered trade mark) substrate to one face of which a polyeurathane coating is applied. The sheets are high frequency welded together adjacent their peripheries with their coated surfaces juxtaposed so that a continuous peripheral seal 18 is formed. An inflation socket 20 is welded about an aperture provided in the outer sheet 14 so that the garment can be attached to a source of pressure fluid and inflated. A zip fastener 22, 24 is stitched to the opposed sides of the blank so as to form a central forward facing openable seam 26 on the garment.

In this embodiment which is a preferred form of the invention, the coated material used produces a fluid-tight garment. However, it is envisaged that the garment need not be wholly fluidtight provided that the fluid leakage therefrom during inflation is less than the volume of fluid supplied.

Indeed, it is envisaged that the inner skin of the garment may be formed of a porous material or one which is given porosity by the formation therein of a multiplicity of orifices, thereby providing a 'vented' garment. It is thought that such a vented garment may have the advantage of cooling and/or ventilating the patient's skin in the area where the garment is worn and also in accelerating wound healing where an open wound is present in such area. The feature of providng a vented garment is not restricted to the foot or leg garments described herein but is applicable to garments adapted to be worn on other parts of the body e.g arm garments which may comprise a simple double-skinned sleeve with or without an openable seam such as a zip fastener.

The blank includes a sole portion 28 which, in part, is defined by peripheral seal portion **18*c* and a weld seam 30. Weld seam 30 extends from the junction between peripheral seal portions 18*a* and 18*b* towards, but stopping short of the end edge 32 of the blank and seals sheets 14 and 16 together along its length. A gap 'g' is left between the sheets of material through which pressure fluid e.g air can flow to inflate the sole portion 28** during inflation of the garment.

In order to form the completed garment, marginal parts of the sheets adjacent the peripheral seal portions **18*a* and 18*b* are secured together as by stitching, and likewise, marginal parts of the sheets adjacent the peripheral seal portions 18*c* and 18*d* are secured together to form seal 34 (FIG. 2**).

When the garment 12 is worn during use and inflated, the foot portion 36 is caused to form three distended 'sacs' S1, S2 and S3 respectively. Sac S1 is formed by inflation of the sole portion 28 between seams 30 and 34. The inner surface 38 of sac S1 provides a 'platform' which meets a substantially horizontal notional plane 'h' passing through the foot portion on which a patient's foot rests. Pressure is applied upwardly by sac S1. Sacs S2 and S3 are formed by parts of the foot portion between seams 26/34 and 26/30 respectively, each of which has an inner surface 40,42 which applies pressure generally downwardly towards the notional horizontal plane 'h' containing inner surface 38 of sac S1.

Hence, pressure is applied to a patient's foot by inflation of the three sacs predominantly from above and from below a horizontal plane passing through the foot portion of the garment.

In use, the garment cyclically is inflated and deflated so as to apply an intermittent compression thereapy to a patient's leg and foot. When the foot portion is constructed as described above, the patient's foot is allowed to remain substantially flat and straight between the sacs so that discomfort arising from pinching of the skin or sideways squeezing of the foot and toes is minimized.

Figure 3:
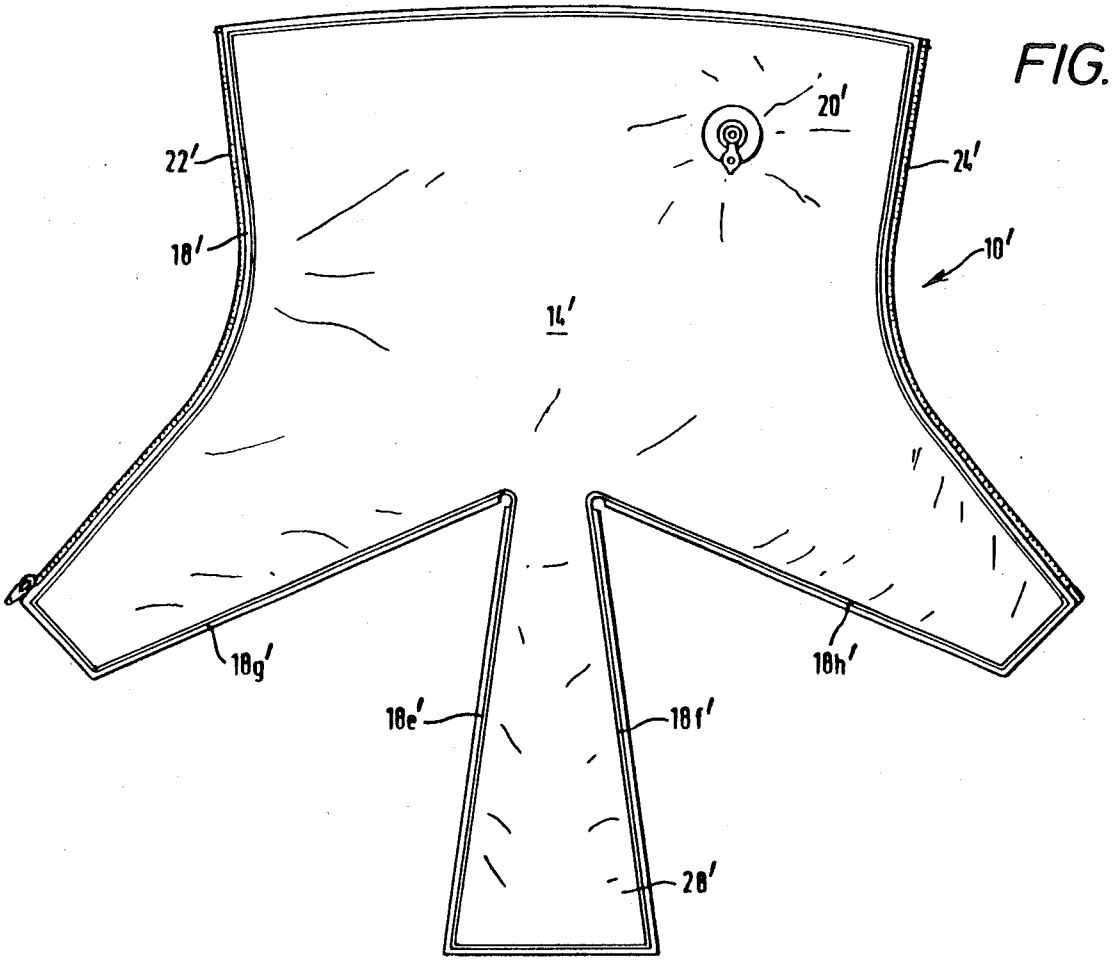
FIG. 3 is a plan view of another fabric blank comprising two superposed sheets of material secured together to form an inflatable garment.
Figure 4:
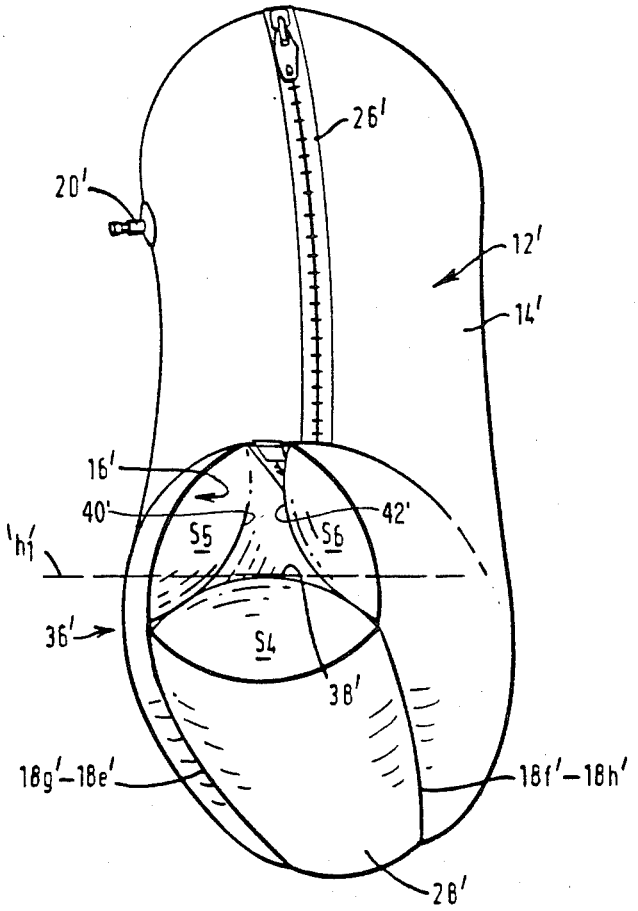
FIG. 4 is a perspective view of a garment in inflated condition as seen from the underside of the foot and formed from the fabric blank shown in FIG. 3.

FIGS. 3 and 4 illustrate a further embodiment of the invention in which a leg garment blank 10' is provided to form an inflatable garment 12'. As in the previous embodiment, the blank is formed from two superposed sheets 14', 16' of material welded together adjacent their peripheries to form a continuous peripheral seal 18'. An inflation socket 20' is provided in outer sheet 14' and a zip fastener 22',24' is stitched in the opposed sides of the blank 10' so as to form a central, forward facing openable seam 26' on the garment.

The blank includes a sole portion 28' which is defined, in part, by peripheral seal portions **18*e'* and 18*f'***.

In order to form the completed garment, marginal parts of the sheets adjacent peripheral seal portions **18*e'* and 18*g'* are secured together as by stitching, and likewise marginal parts of the sheets adjacent the peripheral seal portions 18*f'* and 18*h'*** are also stitched together.

When the garment 12' is worn during use and inflated, foot portion 36' is caused to form three distended 'sacs' S4,S5 and S6, respectively. Sac S4 is formed by inflation of the sole portion 28' between seams **18*g'*–18*e'* and 18*f'*–18*h'*. The inner surface 38' of sac S4 provides a 'platform' which meets a substantially horizontal plane 'h1' passing through the foot portion on which a patient's foot rests. Pressure is applied upwardly by sac S4. Sacs S5 and S6 are formed by parts of the foot portion between seams 26'/18*e'*–18*g'* and 26'/18*f'*–18*h'* respectively, each of which has an inner surface 40',42' which applies pressure generally downwardly towards the notional plane 'h1' containing inner surface 38'** of sac S4.

Figure 5:
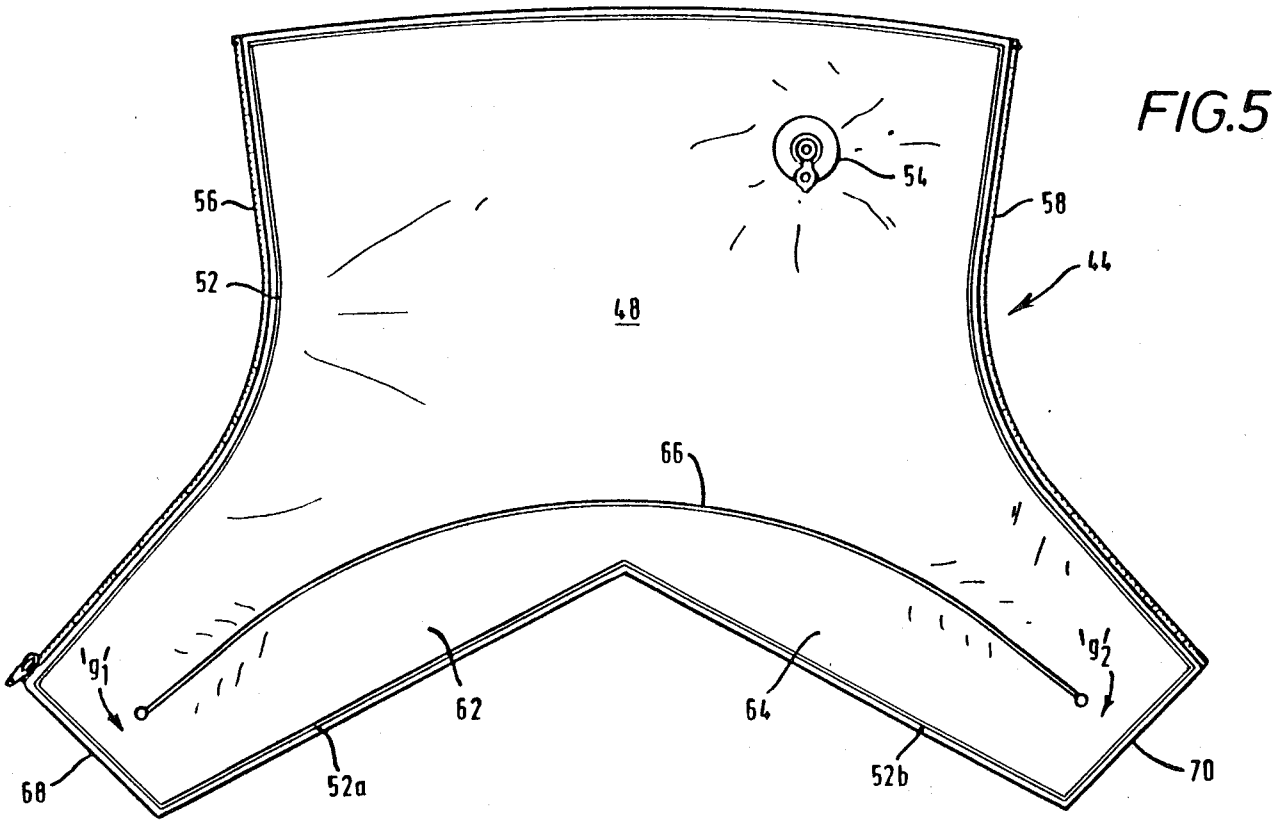
FIG. 5 is a plan view of yet another fabric blank comprising two superposed sheets of material secured together to form an inflatable garment.
Figure 6:
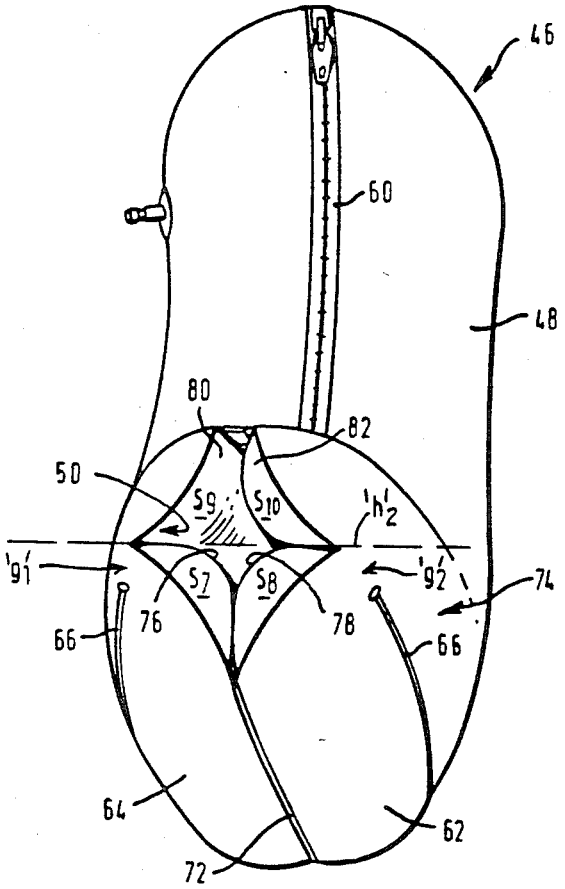
FIG. 6 is a perspective view of a garment in inflated condition as seen from the underside of the foot portion and formed from the fabric blank shown in FIG. 4.

FIGS. 5 and 6 illustrate a still further embodiment of the invention in which a leg garment blank 44 is provided to form inflatable garment 46. As in the previous embodiments the blank is formed from two superposed sheets 48,50 of material welded together adjacent their peripheries to form a continuous peripheral seal 52. An inflation socket 54 is provided in outer sheet 48 and a zip fastener 56,58 is stitched to the opposed sides of the blank 44 so as to form a central, forward facing, openable seam 60 on the garment.

The blank includes a sole portion 62,64 which is, in part, defined by peripheral seal portions **52*a* and 52*b* and an arcuate weld seam 66 which seals sheets 48 and 50 together along its length. The weld seam 66 may be interrupted intermediate its ends to provide a two-part seam, one part in each side of the foot portion. The weld seam 66 stops short of the end edges 68 and 70** of the blank thus creating gaps g1 and g2 between the sheets of material through which pessure fluid can flow when the garment is inflated.

In order to form the completed garment, marginal parts of the sheet adjacent the peripheral seal portions **52*a* and 52*b* are secured together as by stitching to form a central sole seam 72 (FIG. 6**).

When the garment 46 is worn during use and inflated, the foot portion 74 is caused to form four distended 'sacs' S7,S8,S9, S10, respectively. Sacs S7 and S8 are formed by the sole portion 62/64 between the left and right parts of seam 66 and sole seam 72. The inner surfaces 76,78 of sacs S7 and S8 together provide a 'platform' which meets a substantially horizontal notional plane 'h2' passing through the foot portion on which a patient's foot rests. Pressure is applied upwardly by sacs S7 and S8. Sacs S9 and S10 are formed by parts of the foot portion between the left and right parts of seam 66 and central zip seam 60. Each of sacs S9 and S10 has an inner surface 80 and 82, respectively which applies pressure generally downwardly towards the notional horizontal plane 'h2', containing surfaces 76,78 of sacs S7 and S8.

Figure 7:
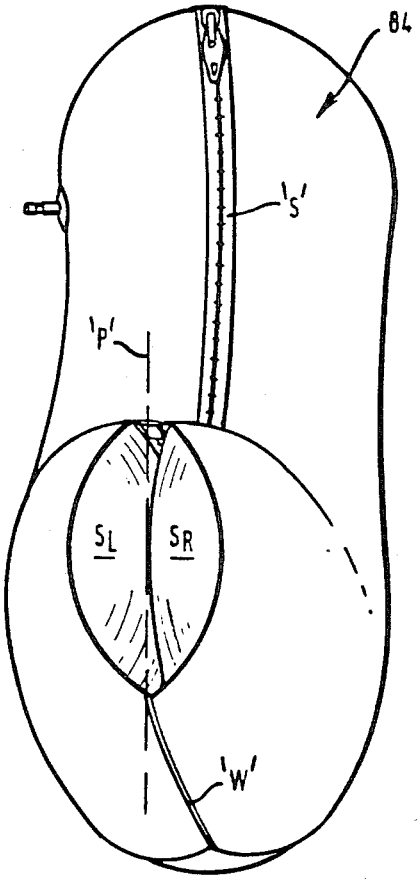
FIG. 7 is a perspective view of a known garment in inflated condition as seen from the underside of the foot portion.

FIG. 7 shows a garment of known construction, which is formed from a blank similar to that shown in FIG. 5. However, in the known construction, the weld seam 66 is not present, so that when the garment is inflated, the foot portion forms two 'sacs' SL and SR which apply pressure inwardly about a notional vertical plane 'p'. This arrangement often causes considerable discomfort to a wearer since a restrictive sideways force is applied to the foot as previously referred to.

What is claimed is:

1. An inflatable legging garment (12,12',46) for use in intermittent compression therapy which garment includes a foot portion (36, 36',74) provided by a plurality of inflatable sacs (S), characterized in that the inflatable sacs are arranged such that, when inflated, pressure is applied thereby inwardly of the foot portion predominantly from above and from below a notional substantially horizontal plane (h) passing centrally through the foot portion of the garment.

2. An inflatable legging garment according to claim 1, further characterised in that a single sac ($S_1$,$S_4$) is disposed below said notional substantially horizontal plane which sac has an inner surface (38,38') which provides a platform on which a wearer's foot is rested and an outer surface providing a sole portion (28,28') of the garment.

3. An inflatable legging garment according to claim 1, further characterised in that a pair of sacs ($S_7$,$S_8$) is disposed below said notional substantially horizontal plane each of which sacs has an inner surface (76,78) which provides a platform on which a wearer's foot is rested and an outer surface providing part of a sole portion (62,64) of the garment.

4. An inflatable legging garment according to either of claims 2 or 3, further characterised in that a pair of sacs ($S_2$,$S_3$;$S_5$,$S_6$; $S_9$,$S_{10}$) is disposed above said notional substantially horizontal plane.

5. An inflatable legging garment according to any of claims 2 or 3, further characterised in that each sac disposed below said notional substantially horizontal plane is defined at least in part by a pair of spaced weld seams formed in the material from which the garment is fabricated.

* * * * *

UNITED STATES PATENT AND TRADEMARK OFFICE

CERTIFICATE OF CORRECTION

PATENT NO. : 4,722,332

DATED : February 2, 1988

INVENTOR(S) : Michael J. Saggers

It is certified that error appears in the above-identified patent and that said Letters Patent is hereby corrected as shown below:

Column 3, line 35, "18f" should read —18f'—;

Column 3, line 44, "18f" should read --18f'—; and

Column 3, line 49, "18f" should read —18f'—.

Signed and Sealed this

Ninth Day of August, 1988

*Attest:*

DONALD J. QUIGG

*Attesting Officer*

*Commissioner of Patents and Trademarks*